US009105218B2

(12) United States Patent
Chen

(10) Patent No.: US 9,105,218 B2
(45) Date of Patent: Aug. 11, 2015

(54) DISPLAY DEVICE CAPABLE OF CONTROLLING EXTERNAL LIGHT AND METHOD FOR CONTROLLING EXTERNAL LIGHT

(75) Inventor: Chien-Chou Chen, New Taipei (TW)

(73) Assignee: AmTRAN TECHNOLOGY CO., LTD., New Taipei (TW)

( * ) Notice: Subject to any disclaimer, the term of this patent is extended or adjusted under 35 U.S.C. 154(b) by 365 days.

(21) Appl. No.: 13/339,964

(22) Filed: Dec. 29, 2011

(65) Prior Publication Data

US 2012/0293561 A1 Nov. 22, 2012

(30) Foreign Application Priority Data

May 18, 2011 (TW) ..... 100117485 A

(51) Int. Cl.
*G09G 3/36* (2006.01)
*G09G 5/10* (2006.01)
*G09G 3/34* (2006.01)

(52) U.S. Cl.
CPC ..... *G09G 5/10* (2013.01); *G09G 3/3413* (2013.01); *G09G 2320/062* (2013.01); *G09G 2320/066* (2013.01); *G09G 2330/021* (2013.01); *G09G 2360/144* (2013.01)

(58) Field of Classification Search
CPC ..... G09G 3/3406–3/3426
USPC ..... 345/102
See application file for complete search history.

(56) References Cited

U.S. PATENT DOCUMENTS

| | | | | |
|---|---|---|---|---|
| 2002/0024509 | A1* | 2/2002 | Yamada et al. | 345/204 |
| 2002/0030791 | A1* | 3/2002 | Ogawa | 353/30 |
| 2005/0264471 | A1* | 12/2005 | Yamazaki et al. | 345/1.1 |
| 2006/0291049 | A1* | 12/2006 | Juenger et al. | 359/443 |
| 2008/0068329 | A1* | 3/2008 | Shestak et al. | 345/102 |
| 2008/0074381 | A1* | 3/2008 | Kumamoto | 345/102 |
| 2008/0094344 | A1* | 4/2008 | Kuroki | 345/102 |
| 2009/0058793 | A1* | 3/2009 | Shin et al. | 345/102 |
| 2013/0073431 | A1* | 3/2013 | Suro et al. | 705/26.61 |

* cited by examiner

*Primary Examiner* — Roy Rabindranath
(74) *Attorney, Agent, or Firm* — Muncy, Geissler, Olds & Lowe, P.C.

(57) ABSTRACT

A display device capable of controlling an external light and a control method are provided. Image display of the display device and the external light are synchronously controlled through a synchronization signal generated by a control module in the display device. The control module generates a first and a second light source control signal during first cycles and second cycles of the synchronization signal. The first and the second light source control signal are used to control the external light to operate at a first operation state and at a second operation state respectively. Through the techniques of controlling the external light by the display device, i.e. turning off or reducing illumination intensity of the external light every other specific period, both influence of the external light on contrast ratio and light reflection from the display device are reduced. Power of the external light is also saved.

7 Claims, 7 Drawing Sheets

DISPLAY DEVICE CAPABLE OF CONTROLLING EXTERNAL LIGHT AND METHOD FOR CONTROLLING EXTERNAL LIGHT

CROSS-REFERENCE TO RELATED APPLICATIONS

This non-provisional application claims priority under 35 U.S.C. §119(a) on Patent Application No(s). 100117485 filed in Taiwan, R.O.C. on May 18, 2011, the entire contents of which are hereby incorporated by reference.

BACKGROUND

1. Technical Field

The present disclosure relates to a display device, and in particular, to a display device capable of controlling an external light and a control method thereof.

2. Related Art

With the advantages of being light, thin, and large-sized, liquid crystal televisions (TVs) and plasma display panel (PDP) TVs already become first choices of television purchasers. An important factor of specifications in selecting TVs or displays is contrast ratio. The contrast ratio refers to a quotient of dividing brightness of white color divided by brightness of black color of a display. A higher contrast ratio means that the display exhibits a clearer distinction between white color and black color, thereby obtaining a better picture quality and a better sense of color level. Therefore, a higher contrast ratio is always pursued by manufacturers in the display industry.

At present, a contrast ratio of the display is measured in a darkroom where brightness of ambient light is lower than 1 lux. However, such definition does not entirely adapt to practical situations. A major reason is that, in actual use, there is usually an environmental light around the display, but the contrast ratio is not measured in a situation having the environmental light. When watching TV, people usually turn on all indoor lights to maintain a bright environment. Therefore, it is not enough to just take the contrast ratio measured in the darkroom as a reference factor for evaluating performance of the display. Instead, what is really seen by human eyes is a visual effect accompanying another contrast ratio which contains an additive contribution from the brightness of external lights in a bright room.

Since the contrast ratio is defined as the quotient of dividing the brightness of white color by the brightness of black color of a display, the contrast ratio may be increased by increasing the brightness of a white image or decreasing the brightness of a black image. However, increase of the brightness of the white image cannot be achieved to a great extent in one aspect due to limitations of current backlight technologies and materials of optical modules related to light guiding, and in another aspect increase of the brightness results in larger power consumption of backlight modules. On the other hand, it is more effective to decrease the brightness of the black image. For example, if originally the brightness of the white image and the brightness of the black image of a display are respectively 500 nits and 1 nit, the contrast ratio is 500 nits/1 nit=500. If the brightness of the white image is increased to 600 nits, the contrast ratio can be increased to 600 nits/1 nit=600. If the brightness of the black image is decreased to 0.5 nit, the contrast ratio can be substantially increased to 500 nits/0.5 nit=1000.

Although dynamic contrast technologies may be used to solve contrast related problems, cost of the display device would be increased, and the contrast ratio is still affected by the external lights. Therefore, in consideration of influence of the environmental light on the display device in an actual use environment, it is desired to develop a technology which improves contrast effect of the display without largely increasing the cost.

SUMMARY

In view of above problems in the prior art, the present disclosure discloses a control method and a system which are applicable to a display for synchronously controlling switching or illumination intensity of an external light. Through the control method and the system, power of the external light can be saved, and contrast effect or light reflection phenomenon of the display can be further improved, thereby solving the problems in the prior art.

A display device capable of controlling an external light according to the embodiment of the present disclosure comprises an image display module, a control module and a signal transmission module. The image display module is used to display a multimedia image. The control module, which is electrically connected to the image display module, responds to a synchronization signal to generate a first light source control signal or a second light source control signal. The synchronization signal is generated during a plurality of first cycles and a plurality of second cycles, the first cycles and the second cycles alternating in temporal order. The control module generates the first light source control signal to control an external light to operate at a first operation state during the first cycles. The control module generates the second light source control signal to control the external light to operate at a second operation state during the second cycles. The signal transmission module, which is electrically connected to the control module, transmits the first light source control signal and/or the second light source control signal.

A control method of an external light according to the embodiment of the present disclosure comprises the following steps. First, a synchronization signal is generated periodically, wherein the synchronization signal is generated during a plurality of first cycles and a plurality of second cycles, and the first cycles and the second cycles alternate in temporal order. A first light source control signal is generated during the plurality of first cycles, wherein the first light source control signal is used to control the external light to operate at a first operation state. The first light source control signal is transmitted to the external light. A second light source control signal is generated during the plurality of second cycles, wherein the second light source control signal is used to control the external light to operate at a second operation state. Then, the second light source control signal is transmitted to the external light.

The display device capable of controlling the external light and the control method according to the embodiment of the present disclosure are capable of synchronously controlling switching or illumination intensity of the external light such that power of the external light can be saved and contrast effect or light reflection phenomenon of the display can be improved.

The above description of the present disclosure and the description of the embodiments below are for demonstrating and illustrating the spirit and principle of the present disclosure, and it also provides further illustration for the scope the present disclosure.

For purposes of summarizing, some aspects, advantages and features of some embodiments of the invention have been described in this summary. Not necessarily all of (or any of)

these summarized aspects, advantages or features will be embodied in any particular embodiment of the invention. Some of these summarized aspects, advantages and features and other aspects, advantages and features may become more fully apparent from the following detailed description and the appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION

The features and advantages of the present disclosure are described in detail in the embodiments below, and the content thereof is enough for those skilled in the art to understand and implement the technical content of the present disclosure. Any one of those skilled in the art can easily understand the relevant objectives and advantages of the present disclosure according to the content disclosed in the specification, claims and drawings. The embodiments below are for further detailed illustration of the present disclosure and are not intended to limit the scope of the present disclosure.

Figure 1:
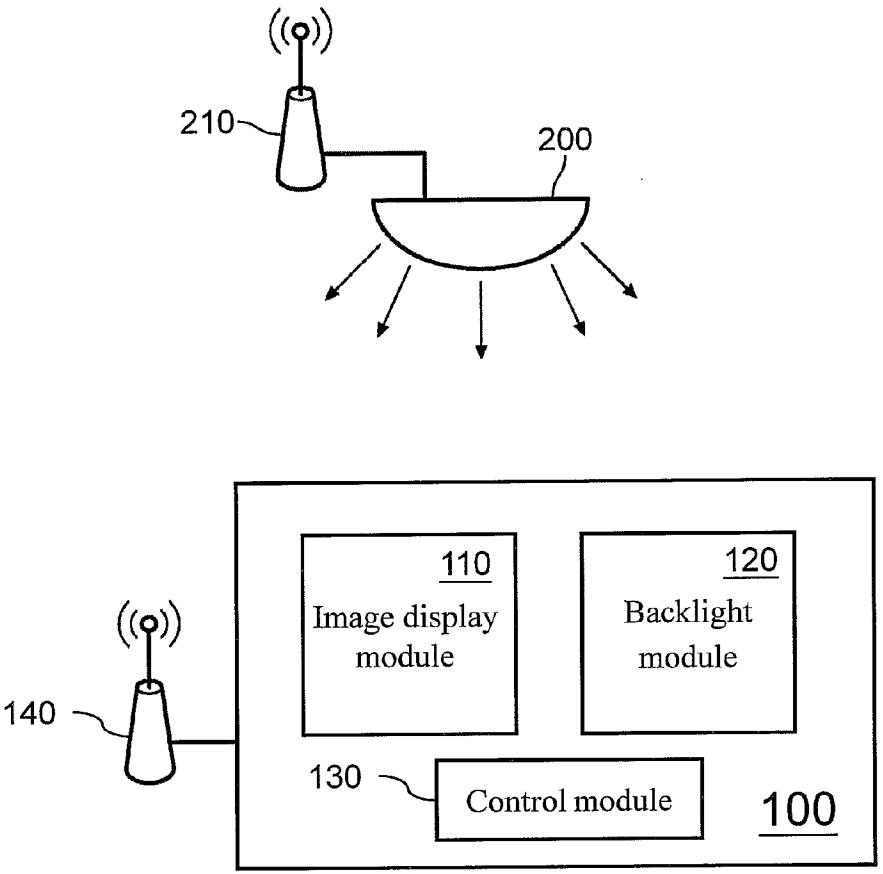
FIG. 1 is a system architectural view of a display device capable of controlling an external light according to the present disclosure.

FIG. 1 is an illustrative system view of a display device capable of controlling an external light according to the present disclosure. According to the embodiment of the present disclosure, a display device 100 is capable of controlling brightness of an external light 200. In this manner, the contrast ratio of the display device is further enhanced. The external light 200 herein generally refers to a light source not configured in the display device, for example, a lighting source in a living room. The external light may be referred as an ambient light source.

The display device 100 comprises an image display module 110. The image display module 110 is used to display a multimedia signal which is generally composed of an image signal and/or an audio signal. Certainly, the image display module 110 only displays the image signal in the multimedia signal.

When the display device 100 is a liquid crystal display (LCD), a backlight module 120 is required. Since the liquid crystal does not emit light, backlight module is functioning as an uniform plane light source so that an LCD screen is capable of displaying the image normally. The backlight module adopts a cold cathode fluorescent tube (CCFL) or light-emitting diodes (LED) as the light source, but the light source is not limited to the above two light sources.

A driving principle of a typical LCD device is briefly described as follows. When a control circuit of the LCD device (or the preceding image display module 110) receives a horizontal synchronization signal (H-sync) and a vertical synchronization signal (V-sync), the control circuit generates a corresponding control signal and transmits the control signal to a data line signal output circuit and a scanning line signal output circuit respectively. Then the data line signal output circuit and the scanning line signal output circuit generate input signals for different data lines and scanning lines according to the control signal, thereby controlling conduction of a thin film transistor of each pixel and the potential difference between two ends of an equivalent capacitor. This further changes the arrangement of liquid crystal molecules and the corresponding light transmission amount to present display data on the LCD device. Since detailed control operations are not the technical scope that the present disclosure intends to protect, the driving principle of the LCD device is briefly described.

The display device 100 further comprises other circuits or modules, which are not in a main protection scope of the present disclosure. Moreover, persons skilled in the art may know the circuits or modules through disclosure in prior arts, and the details are not described herein again. It should only be noted that a control module 130 is configured in the display device 100, and the control module 130 is electrically connected to the image display module 110. The control module 130 is used to respond to a synchronization signal and generates a light source control signal according to the synchronization signal to control the operation of an external light.

Specifically, the control module 130 responds to the synchronization signal to generate a first light source control signal or a second light source control signal, in which the synchronization signal is generated during a plurality of first cycles and a plurality of second cycles, wherein the first cycles and the second cycles alternate in temporal order.

In an embodiment, during the plurality of first cycles, the control module 130 generates the first light source control signal for controlling an external light to operate at a first operation state. During the plurality of second cycles, the control module 130 respectively generates the second light source control signal for controlling the external light to operate at a second operation state.

In an embodiment, the first operation state and the second operation state herein are defined as a turn-on state or a turn-off state of the external light. When the first light source control signal indicates to switch on the external light, the first operation state is a turn-on state of the external light, and the second operation state is a turn-off state of the external light. Therefore, the second light source control signal indicates to switch off the external light. Although in this embodiment, the first operation state and the second operation state are respectively defined as the turn-on state of the external light and the turn-off state of the external light, the first operation state and the second operation state may certainly be respectively defined as the turn-off state and the turn-on state in an opposite manner. In another embodiment, the first operation state may also be defined as the first brightness exhibited by the external light, and the second operation state may be defined as the second brightness exhibited by the external light.

Therefore, in other words, apart from synchronously controlling the turn-on and turn-off of the external light, the brightness of the external light may also be controlled in the embodiment of the present disclosure.

The synchronization signal mentioned in the preceding embodiment may adopt a V-sync signal in a general TV system. The V-sync signal is one of the two basic synchronization signals of the display, and the other one is an H-sync signal. The H-sync signal determines the time for the display to draw a line traversing the screen, and the V-sync determines the time for the display to draw from a top portion to a bottom portion of the screen and then back to an original position. Thus, the V-sync also represents a refresh frequency of the display.

In another embodiment, the control module 130 or other circuits may additionally generate a synchronization signal. The reason of defining the synchronization signal lies in that the signal synchronizes a display frame with light control of the environmental light, a backlight module which will be mentioned hereinafter or an inserted black frame. Therefore, in another embodiment, the light source in the preceding backlight module 120 may also respond to the synchronization signal, so that the light source operates at a first operation state and a second operation state. Definitions of the first operation state and the second operation state herein are similar to the definitions of the first operation state and the second operation state of the external light described above.

In another embodiment, the control module 130 responds to a plurality of first cycles and a plurality of second cycles to generate an inserted black frame. This embodiment may accommodate to the preceding embodiment of controlling the turn-on or turn-off of the backlight module to generate different contrast ratios in accordance with the control of the external light. For example, in an embodiment, the control module 130 generates a first backlight module control signal in the plurality of first cycles. The first backlight module control signal is used to control a backlight module to operate at a first operation state. The control module 130 generates a second backlight module control signal during the plurality of second cycles. The second backlight module control signal is used to control a backlight module to operate at a second operation state. In another embodiment, the control module 130 generates a second backlight module control signal during the plurality of first cycles. The second backlight module control signal is used to control a backlight module to operate at a second operation state. The control module 130 generates a first backlight module control signal during the plurality of second cycles. The first backlight module control signal is used to control a backlight module to operate at a first operation state. The operation details of this part will be described in the following methods and procedures. Certainly, the operation state of the backlight module herein is also similar to the operation state discussed above, that is, the first operation state is a turn-on state of the backlight module, and the second operation state is a turn-off state of the backlight module.

In another embodiment, the first operation state may also be defined as the first brightness exhibited by the backlight module, and the second operation state may be defined as the second brightness exhibited by the backlight module.

A signal transmission module 140 is further configured in the display device 100 and electrically connected to the control module 130. The signal transmission module 140 is used to transmit the first light source control signal and/or the second light source control signal described above to the external light 200.

In cooperation with the technology of the display device 100, a signal transmission module 210 is also configured in the environmental light 200 to receive the first light source control signal and the second light source control signal described above. A corresponding processing circuit is also configured in the environmental light 200 to process the first light source control signal and the second light source control signal, so that the environmental light 200 may respond to the first light source control signal and/or the second light source control signal and operate at the first operation state and/or the second operation state.

In the preceding embodiment, though the signal transmission module 140 and the signal transmission module 210 are used, the signal is merely transmitted from the display device 100 and received by the environmental light 200. Therefore, the transmission and receiving are both unidirectional, and the display device 100 does not further receive any signal transmitted from the environmental light 200. In fact, the display device 100 may be designed to receive a signal transmitted from the environmental light 200 to perform different operations or controls. Therefore, though the signal transmission is unidirectional in the present embodiment, the signal transmission module may certainly perform bidirectional transmission and receiving and have both transmitting and receiving functions.

A communication protocol between the signal transmission module 140 and the signal transmission module 210 is not limited to a particular transmission protocol. Apart from wireless transmission protocol standards such as Radio-frequency Identification (RFID), Wireless Fidelity (WiFi) or BlueTooth, wired transmission protocols may also be applied, such as $I^2C$ serial communication protocol or other private transmission protocols.

The following distinct embodiments and technical effects are described together with the accompanying flow charts and schematic views.

Figure 2:
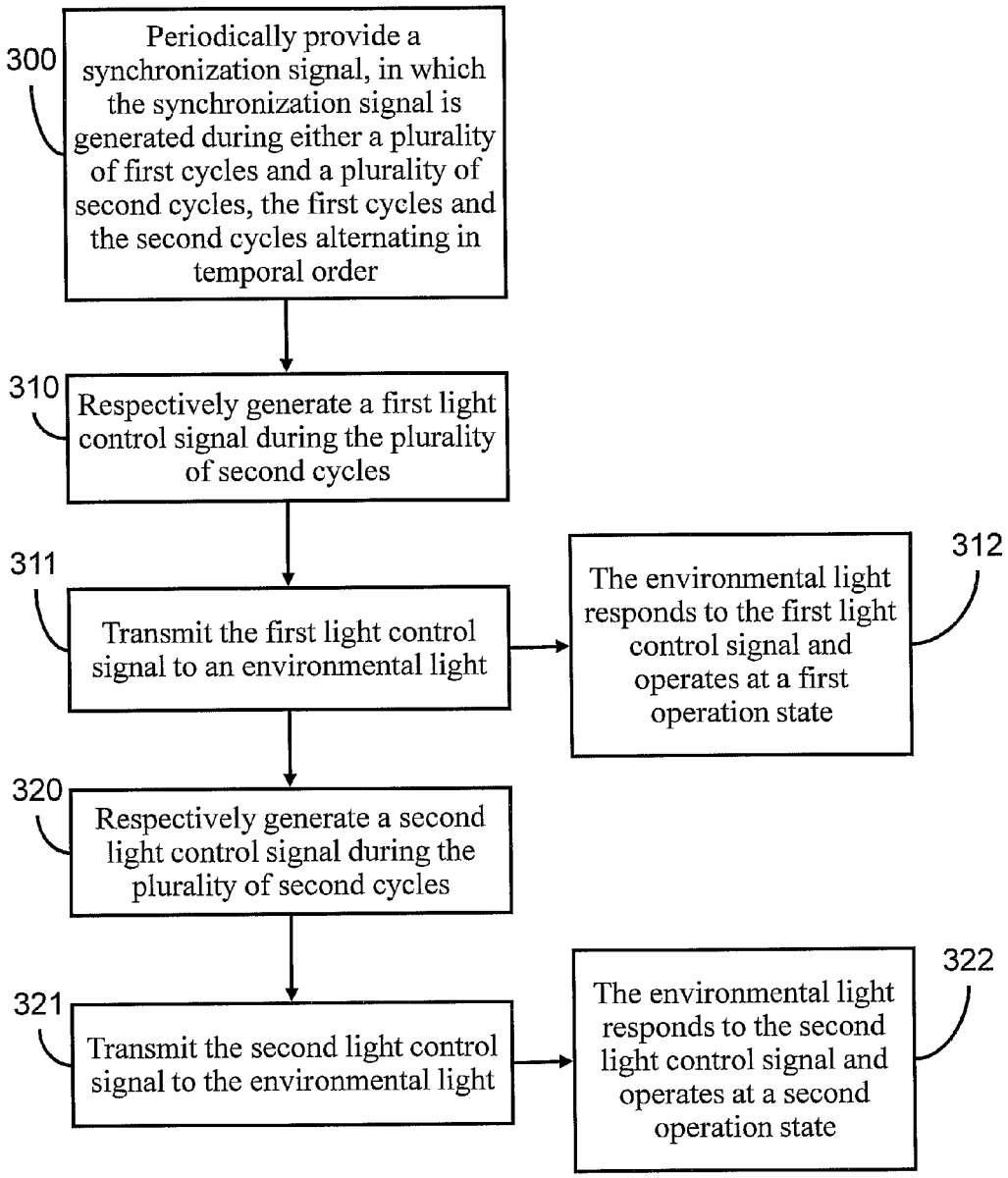
FIG. 2 is a flow chart of a control method of an external light according to a first embodiment of the present disclosure.
Figure 3:
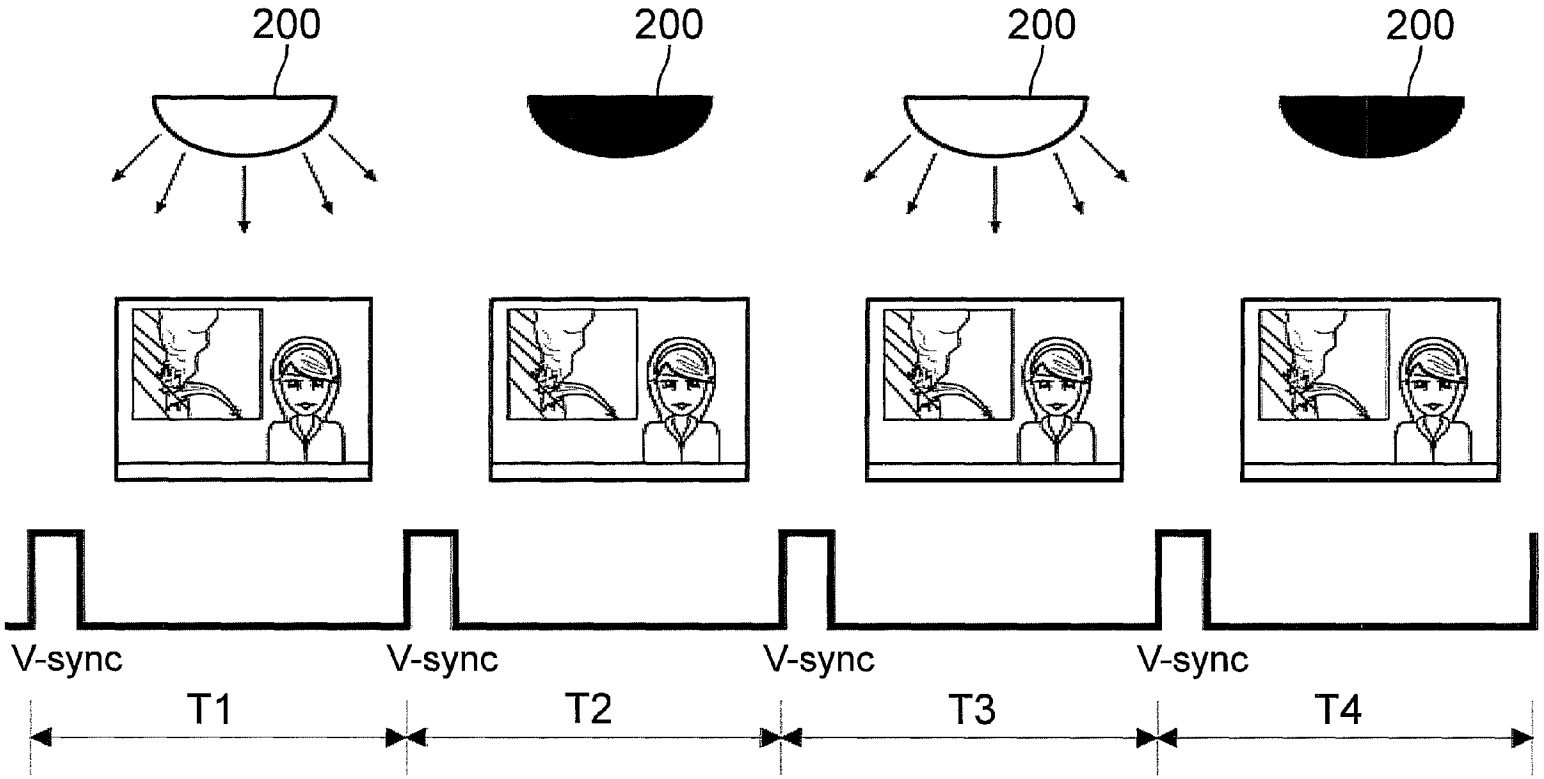
FIG. 3 is a schematic operating diagram of the control method of the external light according to the first embodiment of the present disclosure.

FIG. 2 is a flow chart of a control method of the environmental light according to a first embodiment of the present disclosure. FIG. 3 is a schematic operating diagram of the control method of the environmental light according to the present disclosure.

First, a display device 100 periodically provides a synchronization signal (Step 300), in which the synchronization signal is generated during a plurality of first cycles and a plurality of second cycles. The first cycles and the second cycles alternate in temporal order. In a general TV system, a V-sync signal may be used. Certainly, another synchronization signal may be additionally generated.

Next, a control module 130 respectively generates a first light source control signal during the plurality of second cycles (Step 310), in which the first control signal is used to control an external light to operate at a first state. The control module 130 respectively generates a second light source control signal during the plurality of second cycles (Step 320), in which the second control signal is used to control the external light to operate at a second state.

The steps herein may be summarized as follows. In fact, as shown in FIG. 3, in the first cycles (odd-numbered cycles T1 and T3), an environmental light 200 operates at a first operation state, namely a turn-on state. In the second cycles (even-numbered cycles T2 and T4), the environmental light 200 operates at a second operation state, namely a turn-off state. Certainly, though the first state operation is defined as the turn-on state and the second operation state is defined as the turn-off state, the first operation state may also be defined as a first brightness exhibited by the environmental light in another embodiment, and the second operation state may be defined as a second brightness exhibited by the environmental light in another embodiment.

After generating the first light source control signal, the control module 130 transmits the first light source control signal to the environmental light 200 in a wired or a wireless manner (Step 311), so that the environmental light 200 responds to the first light source control signal and operates at the first operation state (turn-on) or the first brightness (Step 312).

Similarly, after generating the second light source control signal, the control module 130 transmits the second light source control signal to the environmental light 200 in a wired or a wireless manner (Step 321), so that the environmental light 200 responds to the second light source control signal and operates at the second operation state (switch-oft) or the second brightness (Step 322).

Generally, the external light contributes to brightness values of a white image and a black image of the display at the same time. If a contribution to the brightness values is assumed as λ, an actually measured contrast ratio $CR_\lambda$ is shown as follows:

$$CR_\lambda = (\text{brightness of the white image} + \lambda)/(\text{brightness of the black image} + \lambda)$$

Since the brightness value of the black image is a small value, which is even smaller than the brightness of 1 cd/m$^2$ (or nit), the contribution λ of the external light is crucial to the change of the $CR_\lambda$. Even the contribution λ, is only 1 nit, adding on the contribution will make the $CR_\lambda$ greatly decrease compared with an ideal value. For example, if the brightness of the white image is 500 nits, the brightness of the black image is 1 nit, and λ=1 nit, then the contrast ratio measured in a laboratory without influences from the external light is expressed as follows: CR=500/1=500, and the contrast ratio affected by environmental light is expressed as follows: $CR_\lambda$=(500+1)/(1+1)=250.5.

According to the preceding embodiment, the external light may be switched off or the brightness of the external light may be decreased based on a specific cycle to reduce contribution from the external light by a certain amount, thereby obtaining a greater time average contrast ratio. For example, in each odd-numbered cycle, the display device notifies to switch on the external light. In each even-numbered cycle, the display device notifies to switch off the external light. In this way, the contrast when the external light is switched on and the contrast when the external light is switched off both occupy half of a complete time period, and the average contrast ratio is remarkably increased compared with a case in which the technology is not used.

Since the frequency of a general V-sync signal is greater than 60 Hz, switching of the external light will not be easily observed by a user. Moreover, a power saving effect of the external light is achieved. The preceding embodiment is capable of achieving an effect of reducing light reflection of external light rays from a surface of the display. The effect is particularly obvious for the display using a glare-type panel. When the external light is switched on, a part of light rays are reflected by the panel to affect the watching quality of the user. Therefore, the present disclosure is capable of reducing influence of light reflection by periodically switching off the external light.

Figure 4:
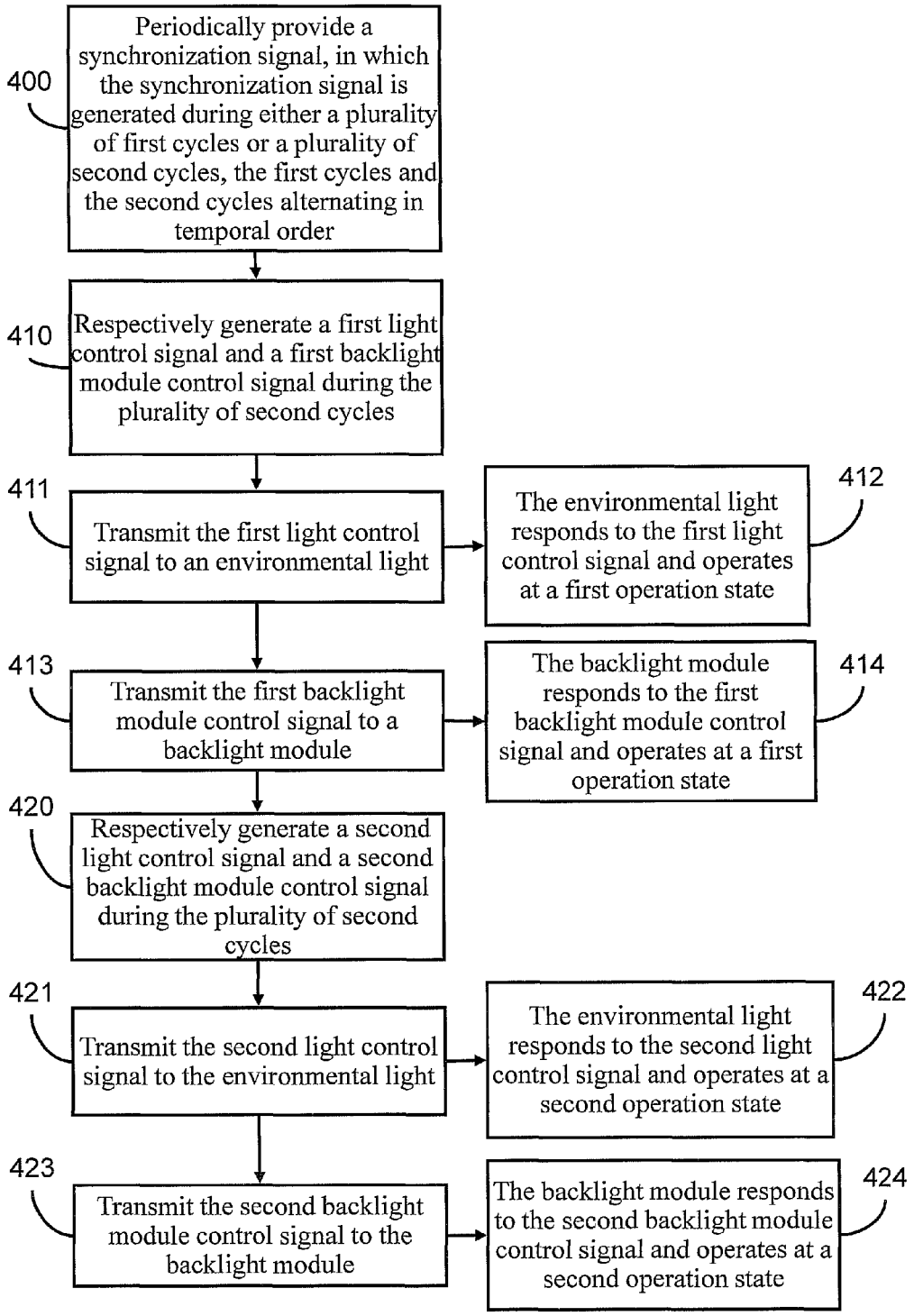
FIG. 4 is a flow chart of a control method of the external light according to a second embodiment of the present disclosure.
Figure 5:
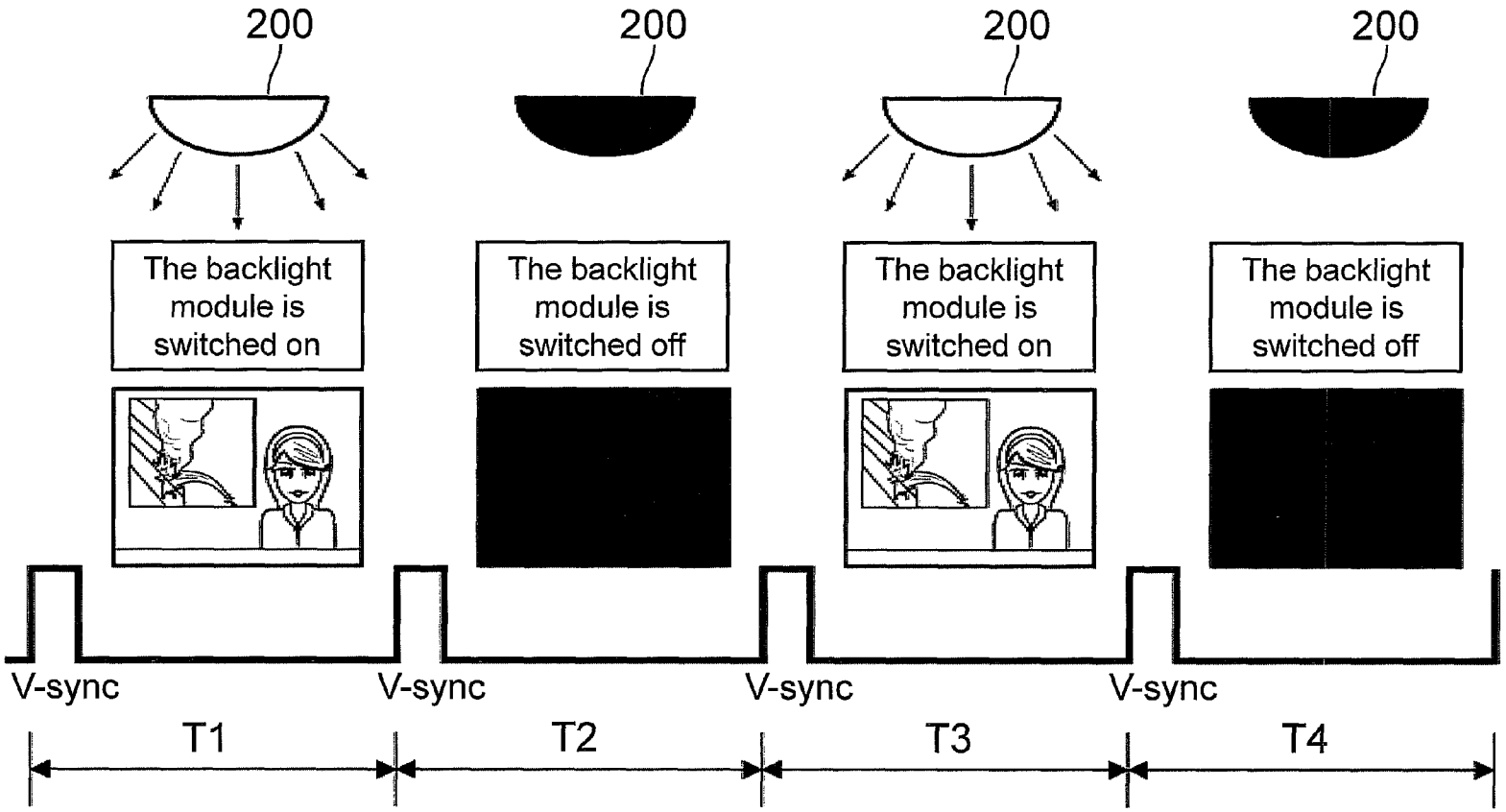
FIG. 5 is a schematic operating diagram of the control method of the external light according to the second embodiment of the present disclosure.
Figure 6:
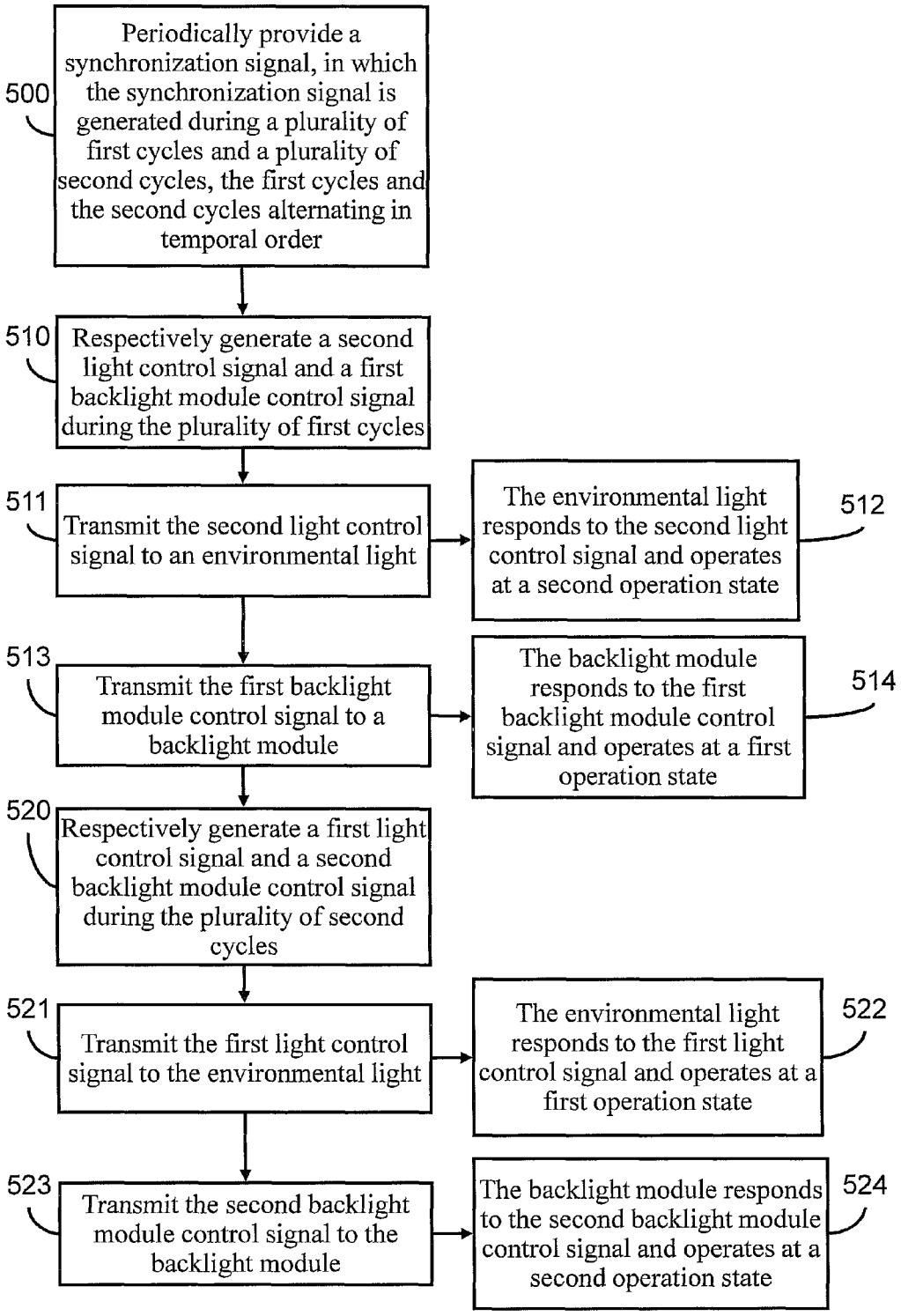
FIG. 6 is a flow chart of a control method of the external light according to a third embodiment of the present disclosure.

FIG. 4 is a flow chart of a control method of the environmental light according to a second embodiment of the present disclosure. FIG. 5 and FIG. 6 are schematic operating diagrams of control methods of the environmental light according to the present disclosure.

First, the display device 100 periodically provides a synchronization signal (Step 400), in which the synchronization signal is generated during a plurality of first cycles and a plurality of second cycles. The first cycles and the second cycles alternate in temporal order. In a general TV system, a V-sync signal may be used. Certainly, another synchronization signal may be additionally generated.

Next, a control module 130 respectively generates a first light source control signal and a first backlight module control signal during the plurality of second cycles (Step 410), in which the first control signal is used to control an external light to operate at a first operation state, and the first backlight module control signal is used to control a backlight module to operate at a first operation state. The control module 130 respectively generates a second light source control signal and a second backlight module control signal during the plurality of second cycles (Step 420), in which the second control signal is used to control the external light to operate at a second operation state, and the second backlight module control signal is used to control a backlight module to operate at a second operation state.

In addition, the control module 130 also responds to the plurality of second cycles to generate an enabling signal which is used to enable an image display module (or related circuits thereof) to generate an inserted black frame (Step 420) and enable the image display module to display a black frame.

In this embodiment, the first operation state and the second operation state of the external light are similar to those in the preceding embodiments. The first operation state is defined as a turn-on state or a first brightness; the second operation state is defined as a turn-off state or a second brightness. Definitions of the first operation state and the second operation state of the backlight module are similar to the definitions of the first operation state and the second operation state of the external light. The first operation state of the backlight module is defined as turn-on or the first brightness, and the second operation state is defined as turn-off or the second brightness.

After generating the first light source control signal, the control module 130 transmits the first light source control signal to the environmental light 200 in a wired or a wireless manner (Step 411) so that the environmental light 200 responds to the first light source control signal and operates at the first operation state (turn-on) or exhibits the first brightness (Step 412). Similarly, after generating the first backlight module control signal, the control module 130 transmits the first backlight module control signal to the backlight module (Step 413) so that the backlight module responds to the first backlight module control signal and operates at the first operation state (turn-on) or exhibits the first brightness (Step 414). It should be noted that, though the steps of transmission are illustrated by Step 411 and Step 413, the transmission sequence is not limited thereto.

After generating the second light source control signal, the control module 130 transmits the second light source control signal to the environmental light 200 in a wired or a wireless manner (Step 421) so that the enviromnental light 200 operates at the second operation state (switch-off) or exhibits the second brightness (Step 422). Similarly, after generating the second backlight module control signal, the control module 130 transmits the second backlight module control signal to the backlight module (Step 423) so that the backlight module responds to the second backlight module control signal and operates at the second operation state (switch-off) or exhibits the second brightness (Step 424).

FIG. 5 shows an implementation type of the embodiment in FIG. 4. In the first cycles (odd-numbered cycles T1 and T3), the environmental light 200 and the backlight module operate at the first operation state, namely the turn-on state. In the second cycles (even-numbered cycles T2 and T4), the environmental light 200 and the backlight module operate at the second operation state, namely the turn-off state. In addition, in the second cycles (even-numbered cycles T2 and T4), the image display module generates an inserted black frame. Though the first operation state is defined as turn-on and the second operation state is defined as turn-off herein, the first operation state may certainly be defined as the first brightness and the second operation state may be defined as the second brightness in another embodiment.

In this embodiment, the backlight of the display and the external light are switched off when the inserted black frame is displayed. At the same time the inserted black frame is displayed, the reflection of the external light is unlikely to occur from a panel. In comparison, the reflection of the external light from the panel when a general frame is displayed is unlikely to disturb a user. Therefore, this embodiment is applicable to users who do not like light reflection.

Figure 7:
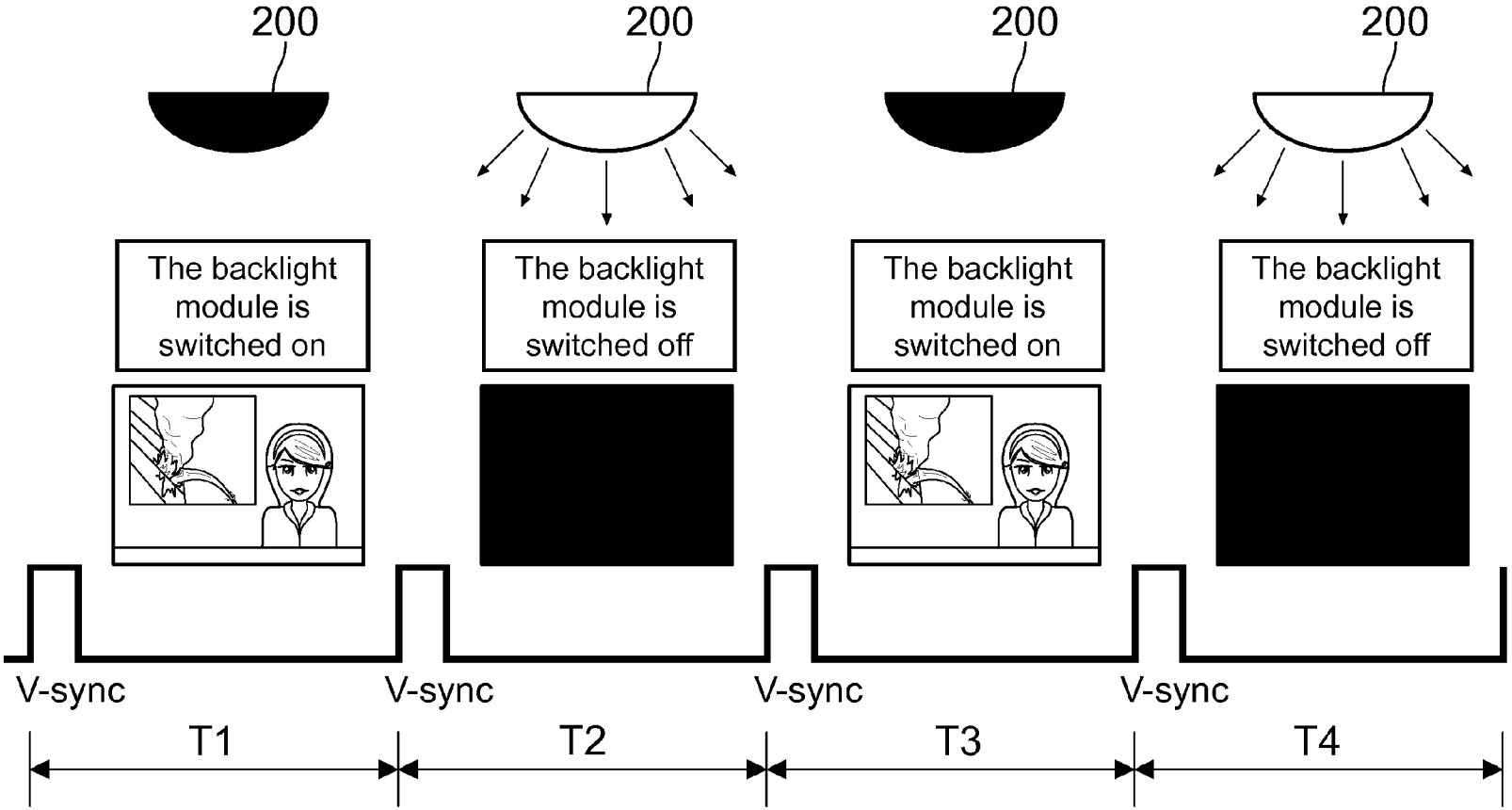
FIG. 7 is a schematic operating diagram of a control method of the external light according to the third embodiment of the present disclosure.

FIG. 6 is a flow chart of a control method of the environmental light according to a third embodiment of the present disclosure. Referring to FIG. 7, it is a schematic operating diagram of the control method of the environmental light according to the present disclosure.

First, a display device 100 periodically provides a synchronization signal (Step 500), in which the synchronization signal is generated during the plurality of first cycles and the plurality of second cycles. In a general TV system, a V-sync signal may be used. Certainly, another synchronization signal may be additionally generated.

Next, a control module 130 respectively generates a second light source control signal and a first backlight module control signal in the plurality of first cycles (Step 510), in which the second light source control signal is used to control an external light to operate at a second operation state and the first backlight module control signal is used to control a backlight module to operate at a first operation state. The control module 130 respectively generates a first light source control signal and a second backlight module control signal in the plurality of second cycles (Step 520), in which the first light source control signal is used to control the external light to operate at a first operation state and the second backlight module control signal is used to control a backlight module to operate at a second operation state. In addition, the control module 130 also responds to the plurality of second cycles to generate an enabling signal which is used to enable an image display module (or related circuits thereof) to generate an inserted black frame (Step 520) and enable the image display module to display a black frame.

In this embodiment, the first operation state and the second operation state of the external light are similar to those in the preceding embodiments. The first operation state is defined as turn-on or a first brightness; the second operation state is defined as turn-off or a second brightness. Definitions of the first operation state and the second operation state of the backlight module are similar to the definitions of the first operation state and the second operation state of the external light. The first operation state of the backlight module is defined as turn-on or the first brightness, and the second operation state is defined as turn-off or the second brightness.

After generating the second light source control signal, the control module 130 transmits the second light source control signal to the environmental light 200 in a wired or a wireless manner (Step 511) so that the environmental light 200 responds to the second light source control signal and operates at the second operation state (the turn-off state) or the second brightness (Step 512). Similarly, after generating the first backlight module control signal, the control module 130 transmits the first backlight module control signal to the backlight module (Step 513) so that the backlight module responds to the first backlight module control signal and operates at the first operation state (turn-on) or the first brightness (Step 514). It should be noted that, though the steps of transmission is illustrated by Step 511 and Step 513, the transmission sequence is not limited thereto.

After generating the first light source control signal, the control module 130 transmits the first light source control signal to the environmental light 200 in a wired or a wireless manner (Step 521) so that the environmental light 200 operates at the first operation state (the turn-on state) or the first brightness (Step 522). Similarly, after generating the second backlight module control signal, the control module 130 transmits the second backlight module control signal to the backlight module (Step 523) so that the backlight module responds to the second backlight module control signal and operates at the second operation state (the turn-off state) or the second brightness (Step 524).

FIG. 7 shows an implementation type of the embodiment in FIG. 6. In the first cycles (odd-numbered cycles T1 and T3), the environmental light 200 operates at the second operation state, namely the turn-off state. The backlight module operates at the first operation state, namely the turn-on state. In the second cycles (even-numbered cycles T2 and T4), the environmental light 200 operates at the first operation state, namely turn-on state. The backlight module operates at the second operation state, namely turn-off state. In addition, in the second cycles (even-numbered cycles T2 and T4), the image display module generates an inserted black frame. Certainly, the operation state herein is similar to the operation state discussed previously.

In this embodiment, when an ordinary frame is displayed, the backlight of the display is switched on and the external light is switched off such that brightness decreases synchronously. At the time, a dark part of the ordinary frame is slightly influenced by the external light, thereby presenting a good contrast effect. When the inserted black frame is displayed, the backlight source is switched off and the external light is switched on synchronously. At this time, it is unnecessary to consider contrast ratio. Therefore, this embodiment is highly applicable to users who prefer a high contrast ratio.

The display device capable of synchronously controlling an external light of the present disclosure may provide a synchronization signal to control periodic switching of an external light module. This may be done by using wired or wireless transmission and receiving devices to achieve objectives of increasing a contrast ratio or reducing light reflection.

In the display capable of synchronously controlling an external light in the present disclosure, when the backlight is switched off and a black frame insertion technology is used, a control module may provide a synchronization signal to control periodic switching of an external light module. This may be done by using wired or wireless transmission and receiving devices to achieve objectives of increasing a contrast ratio, reducing light reflection by synchronizing or reversely synchronizing the switching of the external light module, the switching of a backlight module or an inserted black frame.

Through the techniques of controlling the external light by the display device, i.e. turning off or reducing illumination intensity of the external light every other specific period, both influence of the external light on contrast ratio and reflection from the display device are reduced. Power of the external light is also saved.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A display device capable of synchronously controlling an environmental light, comprising:

an image display module which is used to display a multimedia image;

a control module which is electrically connected to the image display module generating electrical signals and generates a first light source control signal or a second light source control signal in response to a synchronization signal, wherein the synchronization signal is a V-sync signal and generated during a plurality of odd frames where a backlight module is switched on and even frames where the backlight module is switched off, the odd frames and the even frames alternate in temporal order, the control module generates the first light source control signal to control the environmental light to operate at a turn-on state during the odd frames, and the control module generates the second light source control signal to control the environmental light to operate at a turn-off state during the even frames where the backlight module is switched off; and a signal transmission module which is electrically connected to the control module and transmits the first light source control signal and/or the second light source control signal;

wherein the environmental light is capable of illuminating the image display module and the control module responds to the plurality of even frames to generate an inserted black frame so that the image display module displays a black frame.

2. The display device according to claim 1, wherein the environmental light exhibits a first brightness while operating at the turn-on state and exhibits a second brightness while operating at the turn-off state.

3. The display device according to claim 1, wherein the backlight module exhibits a first brightness while operating at the turn-on state and exhibits a second brightness while operating at the turn-off state.

4. The display device according to claim 1, wherein the signal transmission module transmits the first light source control signal and the second light source control signal to the environmental light in a wired or a wireless manner.

5. A control method of an environmental light capable of illuminating an image display module, comprising:

periodically generating a synchronization signal, wherein the synchronization signal is a V-sync signal and generated during a plurality of odd frames where the backlight module is switched on and even frames where a backlight module is switched off, and the odd frames and the even frames alternate in temporal order;

generating a first light source control signal during the plurality of odd frames, wherein the first light source control signal is used to control the environmental light to operate at a turn-on state;

transmitting the first light source control signal to the environmental light; generating a second light source control signal during the plurality of even frames, wherein the second light source control signal is used to control the environmental light to operate at a turn-off state; and transmitting the second light source control signal to the environmental light.

6. The method according to claim 5, wherein the environmental light exhibits a first brightness while operating at the turn-on state and exhibits a second brightness while operating at the turn-off state.

7. The method according to claim 5, wherein the first light source control signal and the second light source control signal are transmitted to the environmental light in a wired or a wireless manner.

* * * * *